US008191683B2

(12) United States Patent
Rathbone et al.

(10) Patent No.: US 8,191,683 B2
(45) Date of Patent: Jun. 5, 2012

(54) HEIGHT REDUCIBLE ELECTRONIC ENCLOSURE COMPATIBLE ENTRANCE PLATFORM

(75) Inventors: Jason Rathbone, Amesbury, MA (US); Frank Labarba, Newburyport, MA (US); Bahram A. Adly, Andover, MA (US)

(73) Assignee: Raytheon Company, Waltham, MA (US)

( * ) Notice: Subject to any disclaimer, the term of this patent is extended or adjusted under 35 U.S.C. 154(b) by 1139 days.

(21) Appl. No.: 12/069,633

(22) Filed: Feb. 12, 2008

(65) Prior Publication Data

US 2009/0200108 A1 Aug. 13, 2009

(51) Int. Cl.
*E06C 9/12* (2006.01)

(52) U.S. Cl. ..... 182/127; 182/84

(58) Field of Classification Search ..... 182/84, 182/127; 280/166
See application file for complete search history.

(56) References Cited

U.S. PATENT DOCUMENTS

| | | | | |
|---|---|---|---|---|
| 1,920,975 | A * | 8/1933 | Eber et al. | 292/45 |
| 4,264,084 | A * | 4/1981 | Telles | 280/166 |
| 5,531,487 | A * | 7/1996 | Beresheim | 292/146 |
| 6,431,093 | B1 * | 8/2002 | Hansen | 108/135 |
| 6,598,704 | B2 * | 7/2003 | Hansen | 182/113 |
| 6,991,277 | B1 * | 1/2006 | Esler | 296/50 |
| 7,090,276 | B1 * | 8/2006 | Bruford et al. | 296/62 |
| 7,673,922 | B1 * | 3/2010 | Grimes | 296/62 |
| 2003/0071433 | A1 * | 4/2003 | Rammer, Jr. | 280/163 |
| 2006/0245886 | A1 * | 11/2006 | Krause | 414/558 |

FOREIGN PATENT DOCUMENTS

JP 404201638 A * 7/1992

* cited by examiner

*Primary Examiner* — Alvin Chin Shue
(74) *Attorney, Agent, or Firm* — Thorpe North & Western LLP

(57) ABSTRACT

The subject invention features an entrance module for a height adjustable enclosure with a top portion movable with the respect to a bottom portion. The preferred entrance module comprises a hingedly attached platform movable between a stowed folded position and a deployed unfolded position. A locking assembly releasably locks the platform in the folded position independent of the position of the top movable part of the shelter. The preferred locking assembly includes a rail attached to the top movable portion of the shelter, one of a female and a male portion of a lock attached to and slideable along the rail, and the other of the female and the male portion of the lock attached to the platform.

12 Claims, 17 Drawing Sheets

HEIGHT REDUCIBLE ELECTRONIC ENCLOSURE COMPATIBLE ENTRANCE PLATFORM

GOVERNMENT RIGHTS

This invention was made with U.S. Government support under Contract No. W31P4Q-04-C-0020 by the U.S. Army. The Government has certain rights in the invention.

FIELD OF THE INVENTION

This subject invention relates to a platform for a height reducible electronics enclosure and, more generally, to a platform or dock for any vehicle or structure.

BACKGROUND OF THE INVENTION

The military uses shelter enclosures on vehicles such as HMMWVs for many different applications. One type of shelter is height reducible so that it can be driven on or off of a cargo plane (e.g., a C 130 cargo plane) without having to remove the shelter from the truck. The door of such an enclosure is 70" inches off the ground. Therefore, some type of a ladder or stairway is required for easier access into the shelter. Also, in some configurations, a protective entrance is desired adjacent the door to the enclosure in case of a chemical attack. A platform is thus required for the protective entrance and a stairway or ladder is required to access the platform.

The design constraints for a platform and stairway or ladder are fairly severe. For example, the platform must fold up and be locked in place when the vehicle is driven away during road march. The platform must also fold open to allow for quick deployment. Hydraulic systems and the like are generally not favored since they add to the complexity, weight, and cost of the shelter system. Also, the ladder and platform or stairway cannot interfere with the raising and lowering of the top half of the shelter. A single person must be able to deploy and fold the platform down quickly and easily.

No known systems meet these requirements.

BRIEF SUMMARY OF THE INVENTION

It is therefore an object of this invention to provide a new platform for a truck mounted shelter enclosure.

It is a further object of this invention to provide such a platform which can be used in connection with a height reducible electronics enclosure.

It is a further object of this invention to provide such a platform which includes bracketry to stow and mount a ladder.

It is a further object of this invention to provide such a platform which is configured to accommodate a protective entrance in the event of a chemical attack.

It is a further object of this invention to provide such a platform which folds up (road march) and folds down (deployment) quickly and easily.

It is a further object of this invention to provide such a platform which can be folded and deployed quickly and easily by one person.

It is a further object of this invention to provide such a platform which does not require hydraulic or similar systems for folding or deployment.

It is a further object of this invention to provide such a platform which folds and deploys independent of the operation of the height reducible electronics enclosure.

It is a further object of this invention to provide such a platform which can be used in connection with other vehicles and/or can be attached to other structures.

The subject invention results from the realization that a better platform for a vehicle is engineered to fold up (road march) and fold down independent of and without interfering with the operation of the height reducible enclosure and, in one embodiment, includes a torsion/bending bar assembly to more easily fold and deploy the platform.

The subject invention features an entrance module for a height adjustable enclosure with a top portion movable with the respect to a bottom portion. The preferred entrance module comprises a hingedly attached platform movable between a stowed folded position and a deployed unfolded position. A locking assembly releasably locks the platform in the folded position independent of the position of the top movable part of the shelter. The preferred locking assembly includes a rail attached to the top movable portion of the shelter, one of a female and a male portion of a lock attached to and slideable along the rail, and the other of the female and the male portion of the lock attached to the platform.

In one example, the male portion includes a rod affixed to and slideable with respect to the platform and the female portion includes a bracket with an orifice for receiving the rod therethrough. Preferably, the platform is hingedly attached via a torsion bar assembly. One torsion bar assembly example includes a plurality of bars constrained on one end to rotate with the platform and constrained on the other end to remain fixed as the platform rotates. Typically, the bars of the torsion bar assembly extend between two spaced hubs. One hub includes a non-circular orifice therethrough for receiving a non-circular crank which rotates with the platform.

The entrance module may include at least one cable support tie connected on one end to the portion of the lock slideable along the rail and attached on the other end to the platform. The entrance may also include a ladder for the platform. Typically, the ladder is removable from the platform and stowable under the platform. The entrance module may further include at least one safety railing foldable with respect to the platform. The entrance module may further include a protective entrance positionable on the platform.

The subject invention also features a dock for a vehicle. A platform is hingedly attached to the vehicle and is movable between a stowed folded position and a deployed unfolded position. A torsion bar assembly includes a plurality of bars constrained on one end to rotate with the platform and constrained on the other end to remain fixed as the platform rotates. In one embodiment, the bars of the torsion bar assembly extend between two spaced hubs. One hub includes a non-circular orifice therethrough for receiving a non-circular crank which rotates with the platform. Also included is a locking assembly for releasably locking the platform in the folded position.

One dock for a vehicle includes a platform, spaced first and second brackets for mounting to the vehicle, and spaced first and second ears on the platform rotatably mounted to the first and second brackets, respectively. A torsion bar assembly includes a plurality of rods fixed on one end to a first hub and fixed on an opposite end to a second hub. The first hub is fixed with the respect to the first bracket. The second hub includes a crank receptacle and a crank is fixed to the second ear and received in the crank receptacle so the second hub is constrain to rotate with the platform.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
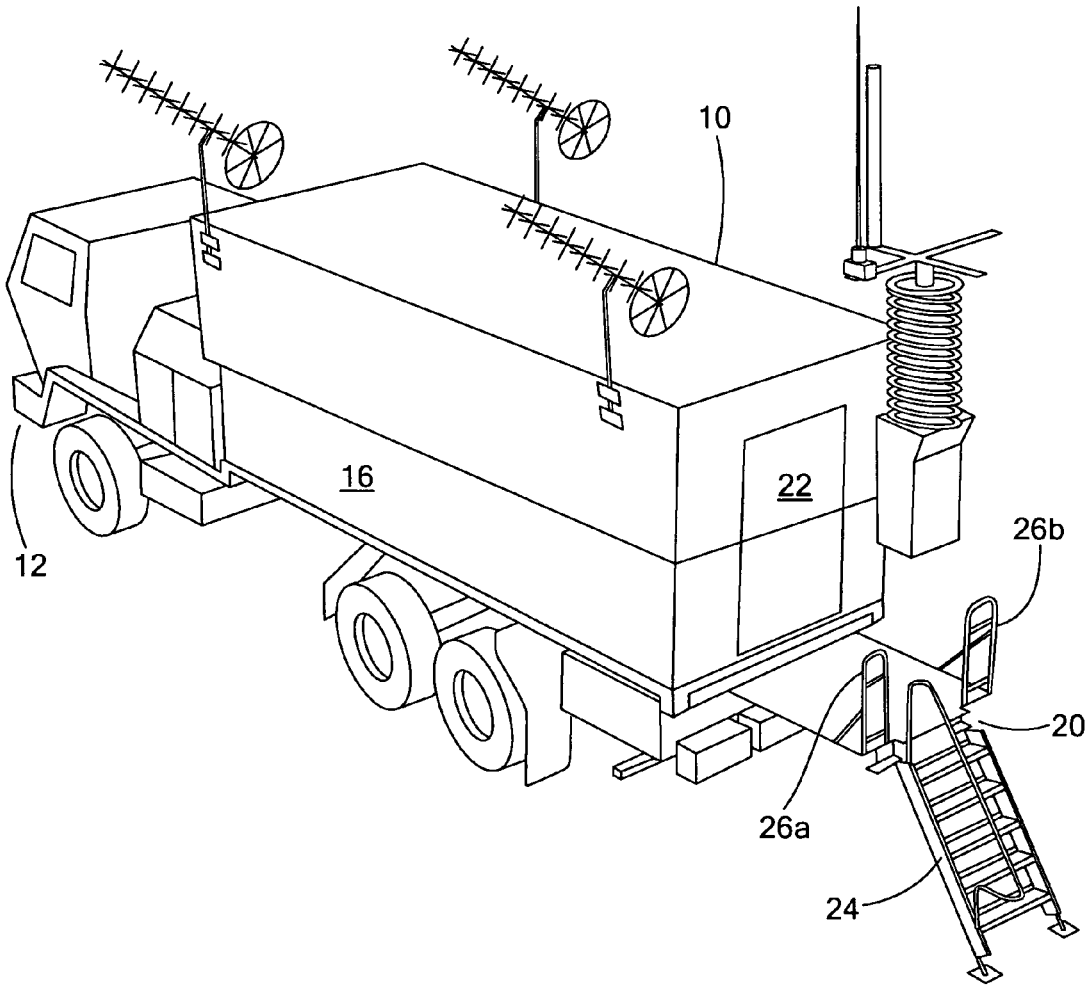
FIG. 1 is a schematic three-dimensional view showing an example of a platform attached to a height reducible electronics enclosure mounted on a vehicle in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
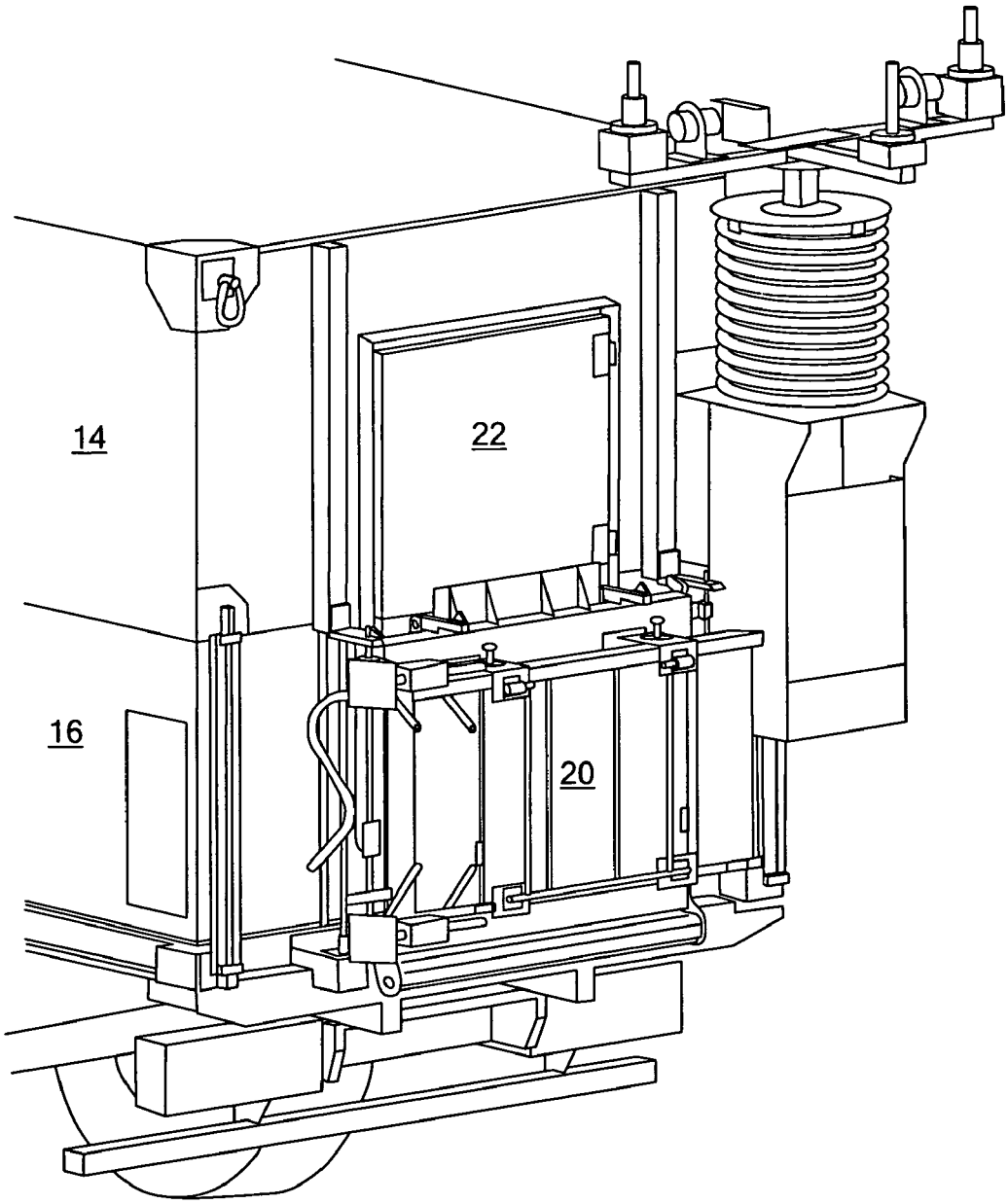
FIG. 2 is a schematic three-dimensional rear view showing the platform folded up adjacent the door of the enclosure.
Figure 3:
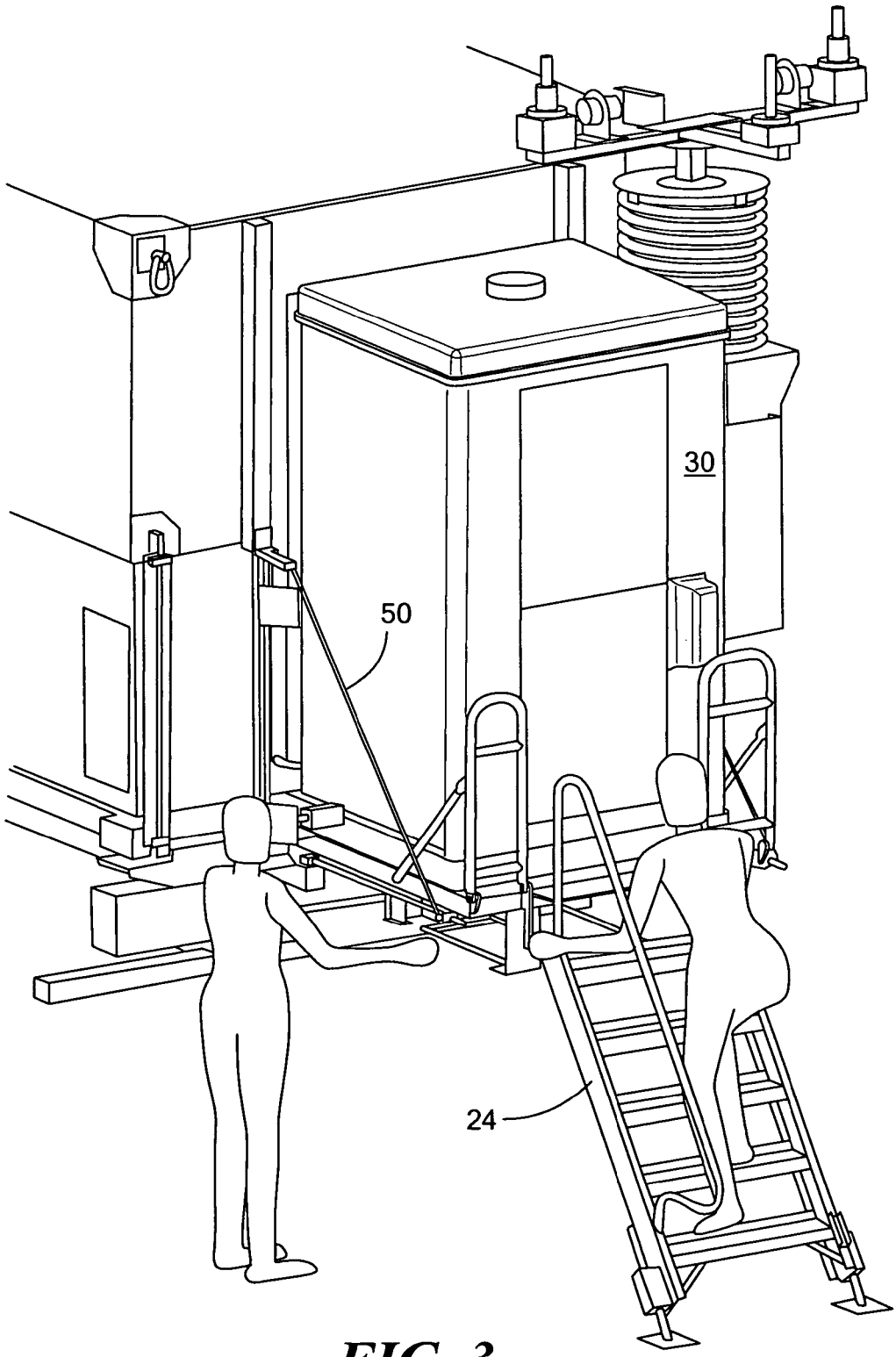
FIG. 3 is a schematic three-dimensional rear view showing the platform in its deployed position and with an entrance mounted thereon in accordance with the subject invention.

FIG. 1 shows height adjustable enclosure 10 mounted to the bed of vehicle 12 and including top portion 14 movable up and down with respect to bottom portion 16. Platform 20 is hingedly attached to the bed of vehicle 12 or enclosure bottom portion 16 adjacent door 22 and is movable between a deployed unfolded position as shown in FIG. 1 and a stowed folded position as shown in FIG. 2. In this particular example, ladder 24 is included as are safety railings 26*a* and 26*b* which fold as discussed below. FIG. 3 shows protective entrance 30 on the platform.

Figure 4:
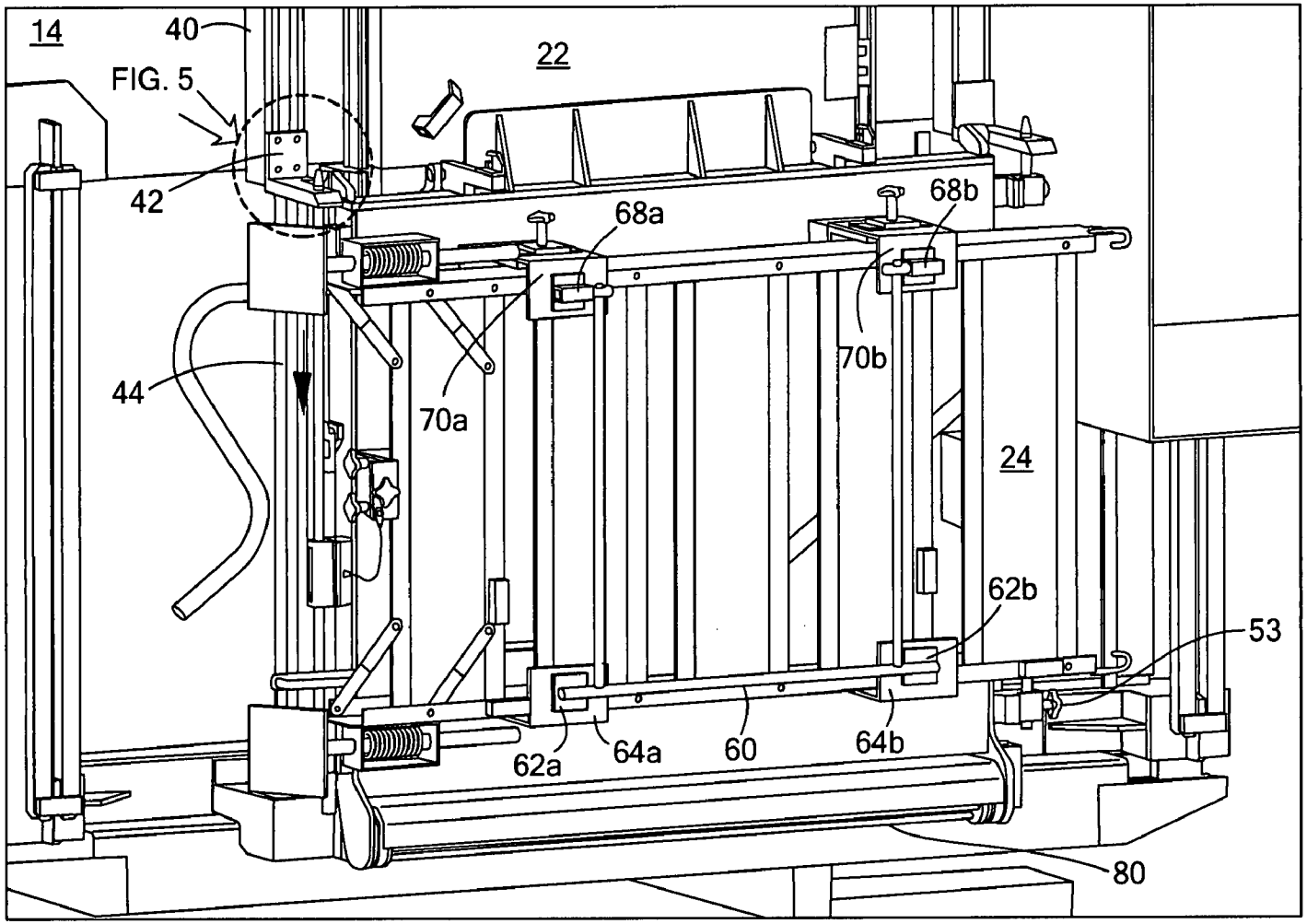
FIG. 4 is a schematic three-dimensional view again showing the platform in its folded position.
Figure 5:
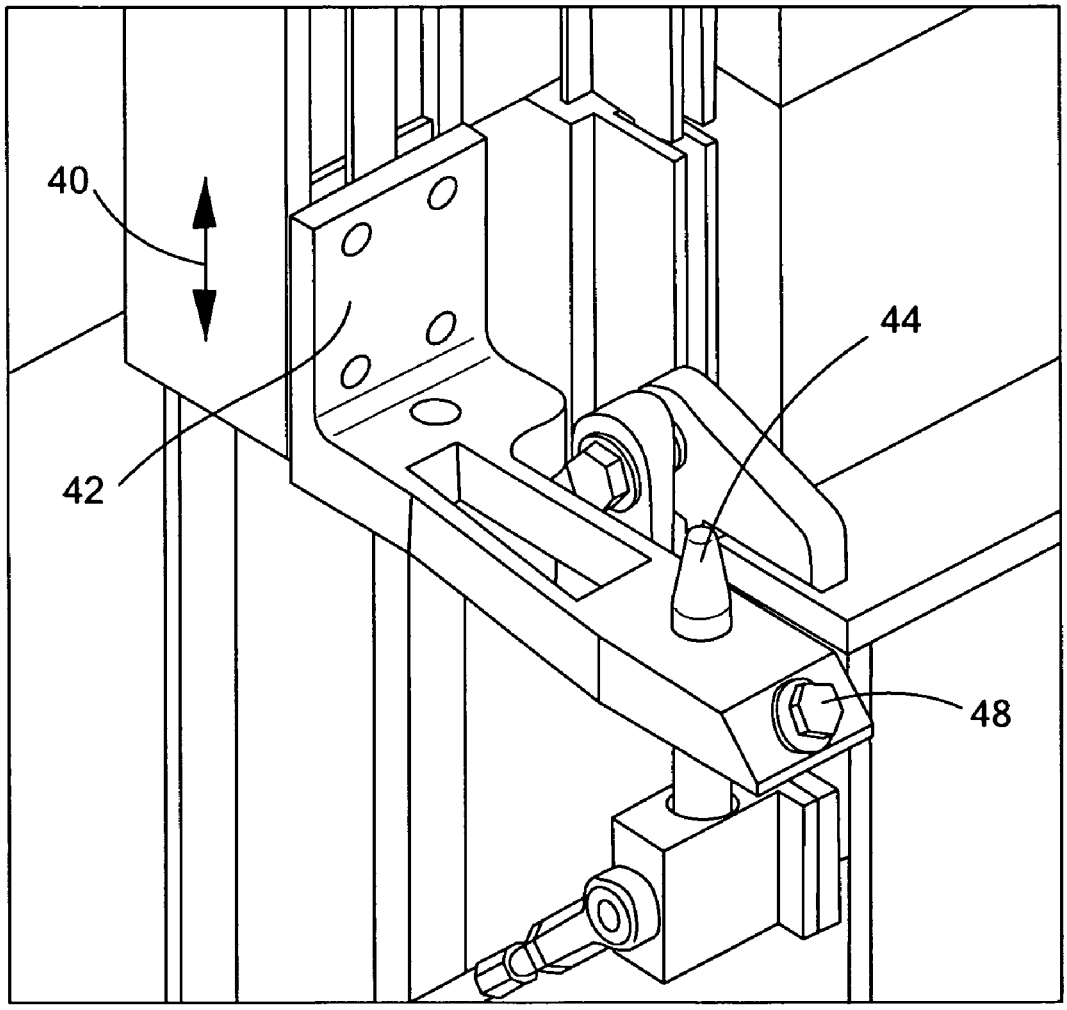
FIG. 5 is a schematic three-dimensional more detailed view showing the locking mechanism for retaining the platform in its folded position.

FIGS. 4-5 show one preferred example of a locking assembly for releasably locking the platform in the folded position independent of the position or motion of the top movable portion 14 of the shelter. The locking assembly in this example includes vertical rail 40 attached to the top movable portion 14 of the shelter and bracket 42 attached to and slideable with respect to rail 40. Bracket 42 includes an orifice for receiving rod 44 attached to the platform. Rod 44 slides up to radially lock into bracket 42 when the platform is folded and rod 44 slides down out of engagement with bracket 42 when the platform is deployed. Bracket 42, in turn, stays fixed in place independent of the motion of the top half 14 of the shelter since it slides in rail 40. Bracket 44, FIG. 5 may also include fastener 48 for a cable which extends down to the platform (see cable 50, FIG. 3) for support of the platform. A similar locking assembly is typically featured on the other side of the platform as shown generally at 50 in FIG. 4. A threaded knob assembly and handle 53 on each side of the platform is used to disengage the rods 44 from their respective brackets 42. In this way, the top half 14 of the shelter can be raised or lowered when the platform is deployed or folded and the platform can be deployed or folded independent of the raising or lowering of the top half of the shelter.

FIG. 4 also shows ladder 24 stowable on the bottom side of the platform when the platform is folded up adjacent the enclosure door. Handle 60 is held in place by spring clips 62*a* and 62*b* on ladder storage bracket 64*a* and 64*b*. Handle 60 pivots up and outwardly in the direction shown by arrow 66 via hinges 68*a* and 68*b* on ladder storage brackets 70*a* and 70*b*.

FIG. 4 also shows torsion bar assembly 80 which hingedly attaches the platform in a manner in which it deploys and unfolds slowly and without significant effort on the part of the operator. Torsion/bending bar assembly 80 also assists in an easier operation for folding the platform up adjacent the enclosure.

Figure 6:
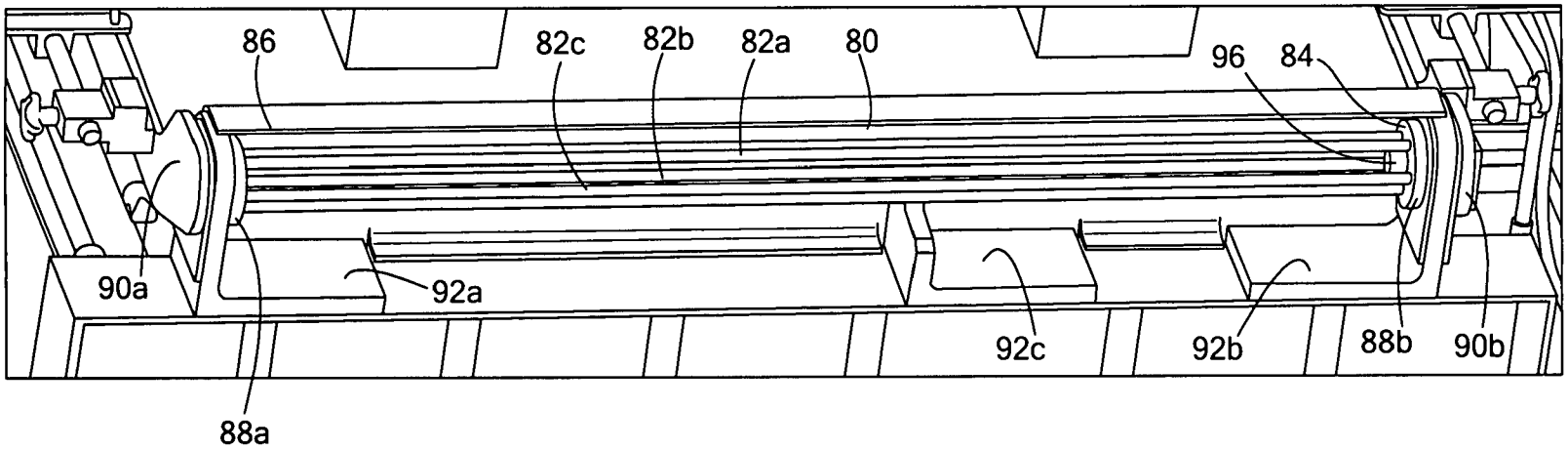
FIG. 6 is a schematic three-dimensional view showing an example of a torsion bar for the platform of the subject invention.
Figure 7:
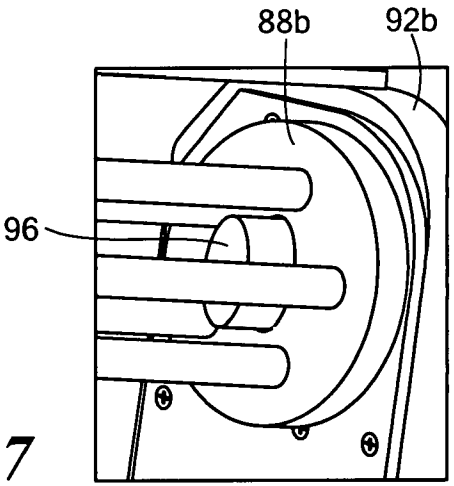
FIG. 7 is a schematic three-dimensional view showing in more detail a portion of the torsion bar assembly of FIG. 6.

In one example, torsion/bending bar assembly 80, FIG. 6 includes a plurality of bars 82 constrained on end 84 to rotate with the platform and constrained on end 86 to remain fixed as the platform rotates. Bars 82 each extend between hubs 88*a* and 88*b*. Ears 90*a* and 90*b* are attached to the sides of the platform, brackets 92*a*, 92*b* and 92*c* are attached to the frame of the vehicle, and ears 90*a* and 90*b* are rotatably mounted to the brackets 92*a*, 92*b*, and 92*c*. Hub 88*a* is bolted to bracket 92*a*. Hub 88*b*, FIGS. 6 and 7, includes an oval shaped receptacle for receiving oval shaped crank 96 fixed to ear 90*b*. This arrangement constrains the rotation of hub 88*b* with the rotation of the platform.

The combination of bending and torsion provided by torsion/bending bar assembly 80 lowers the sheer stress of the rods 82 as the platform is lowered. Sheer stress is reduced because the rods bend and twist while the platform is being lowered. Also, the oval crank design associated with crank 96 eliminates stress concentration points.

Figure 8A:
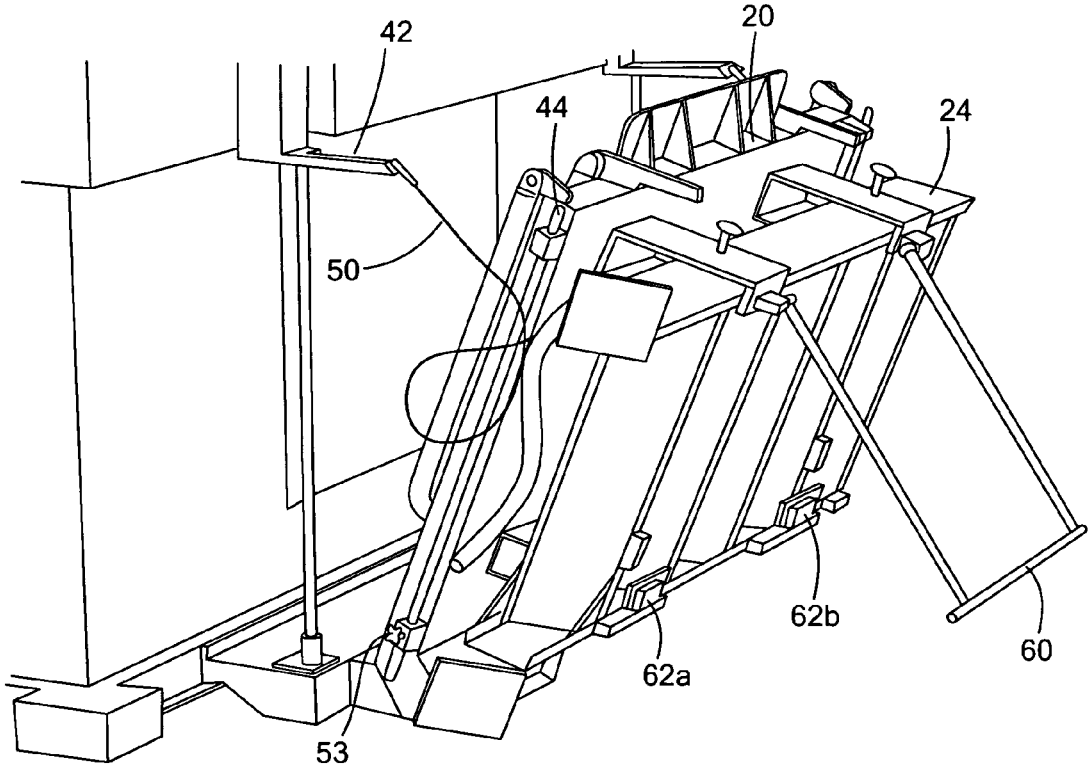
FIGS. 8A-8F are schematic three-dimensional views showing various steps associated with deploying the platform of the subject invention.
Figure 8B:
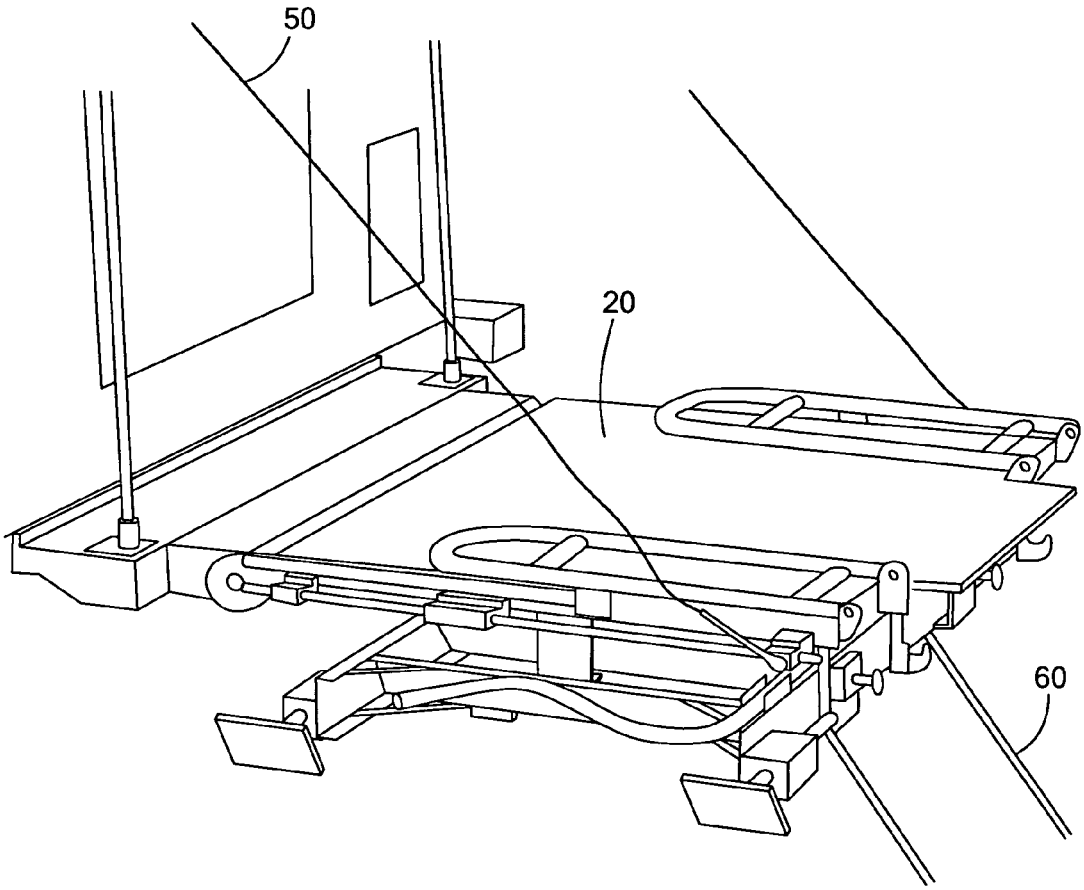
Figure 8C:
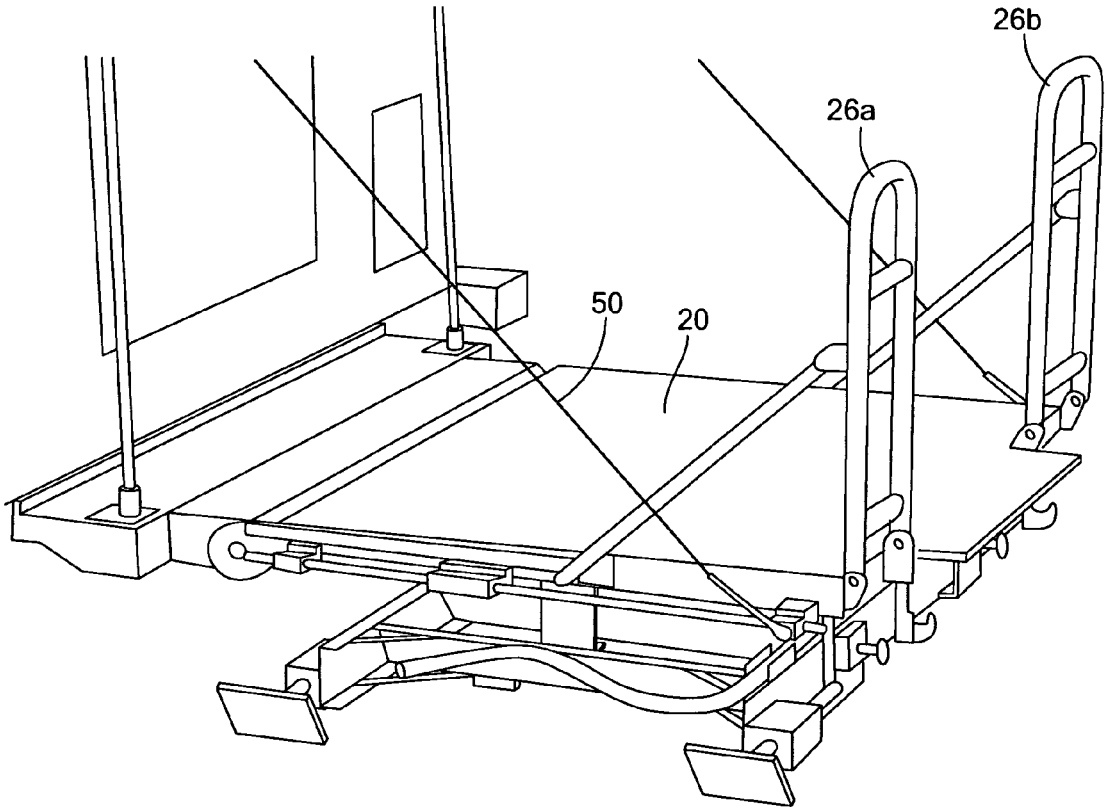
Figure 8D:
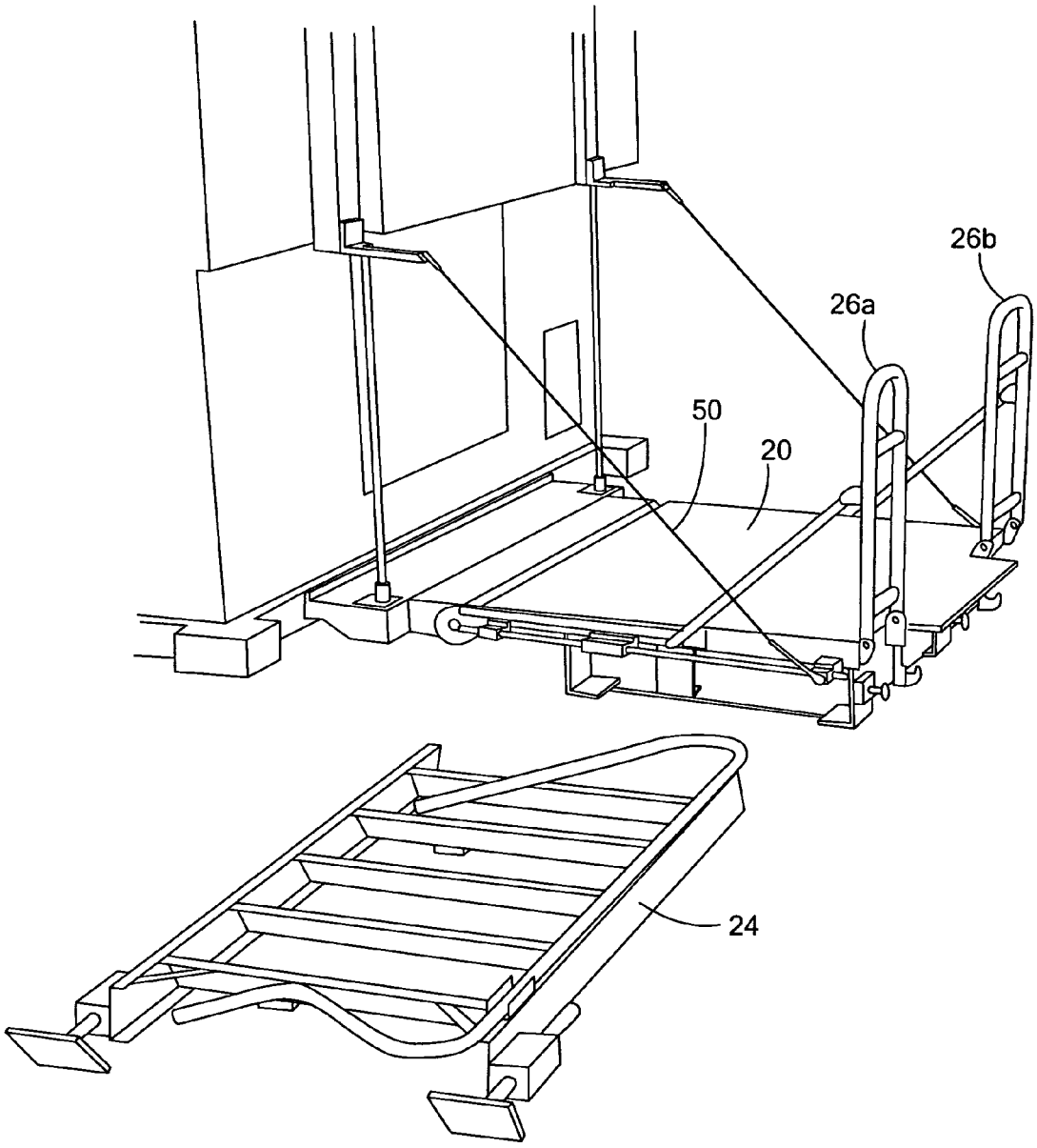
Figure 8E:
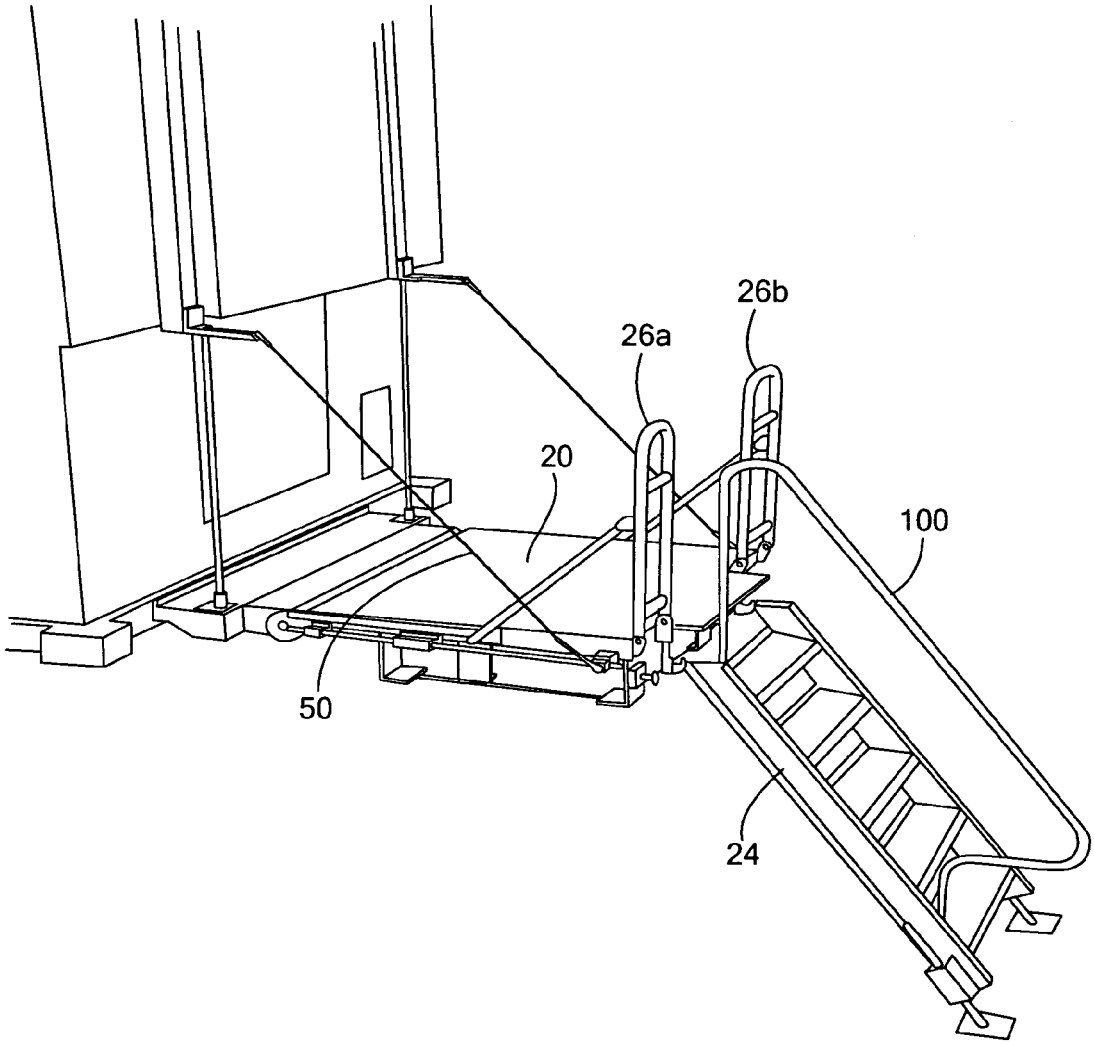
Figure 8F:
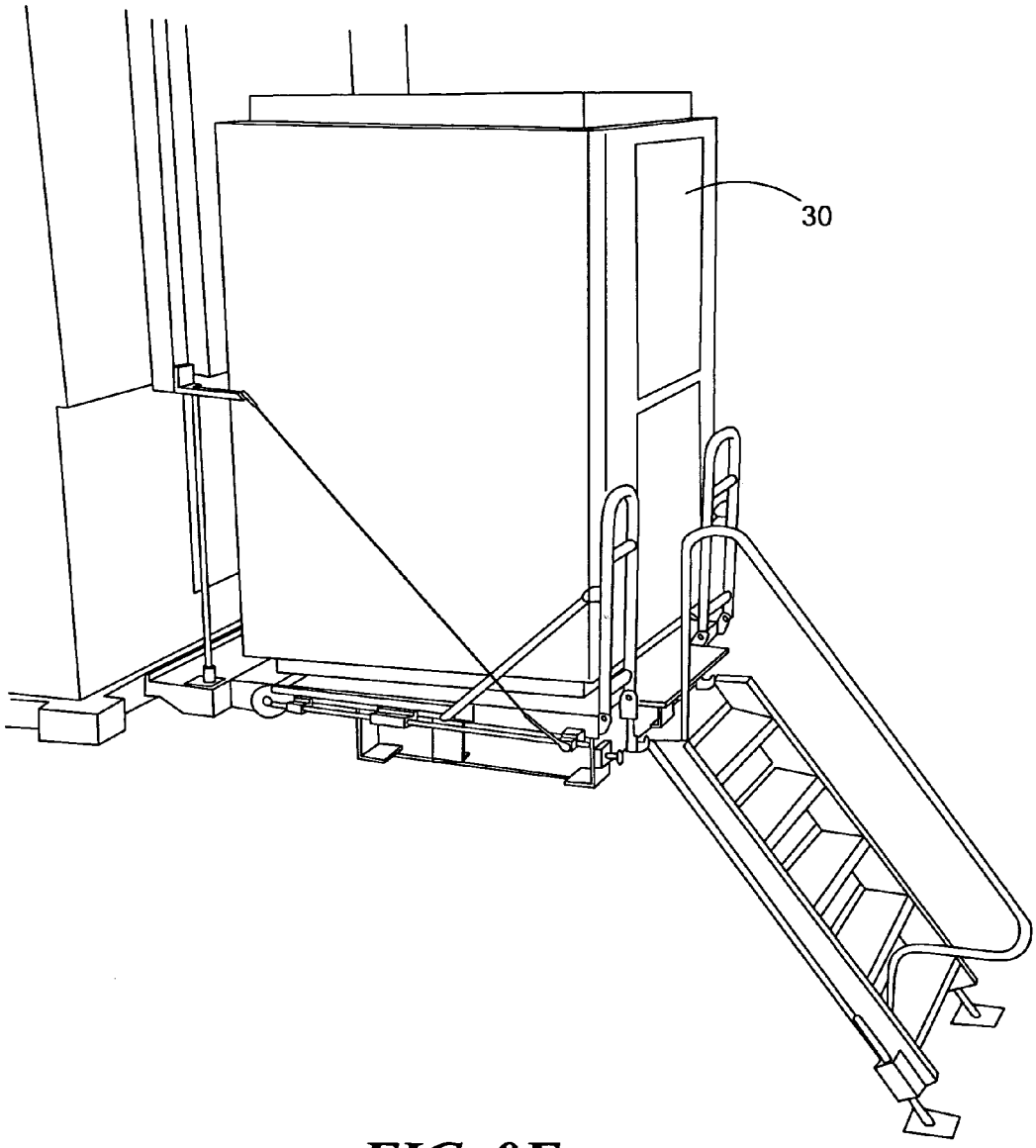

FIGS. 8A-8F show the general operation associated with deploying the platform from its folded position. In FIG. 8A, handle 53 has been pulled which releases rod 44 from bracket 42. Also, handle bar 60 has been released from spring chips 62*a* and 62*b* to assist in deploying the platform. Platform 20 now begins pivoting downward assisted by a slight pull on handle bar 60. In FIG. 8B, platform 20 is fully deployed. In FIG. 8C railings 26*a* and 26*b* are folded up and locked in place. In FIG. 8D, the pins holding stair 24 in its brackets (70*a*, 70*b*, 64*a*, 64*b*, FIG. 4) have been pulled and stair 24 is removed from its stored location under platform 20. In FIG. 8E, stair 24 is coupled to platform 20 and handrail 100 is deployed. In FIG. 8F, optional protective entrance 30 is secured to the top of the platform.

Figure 9:
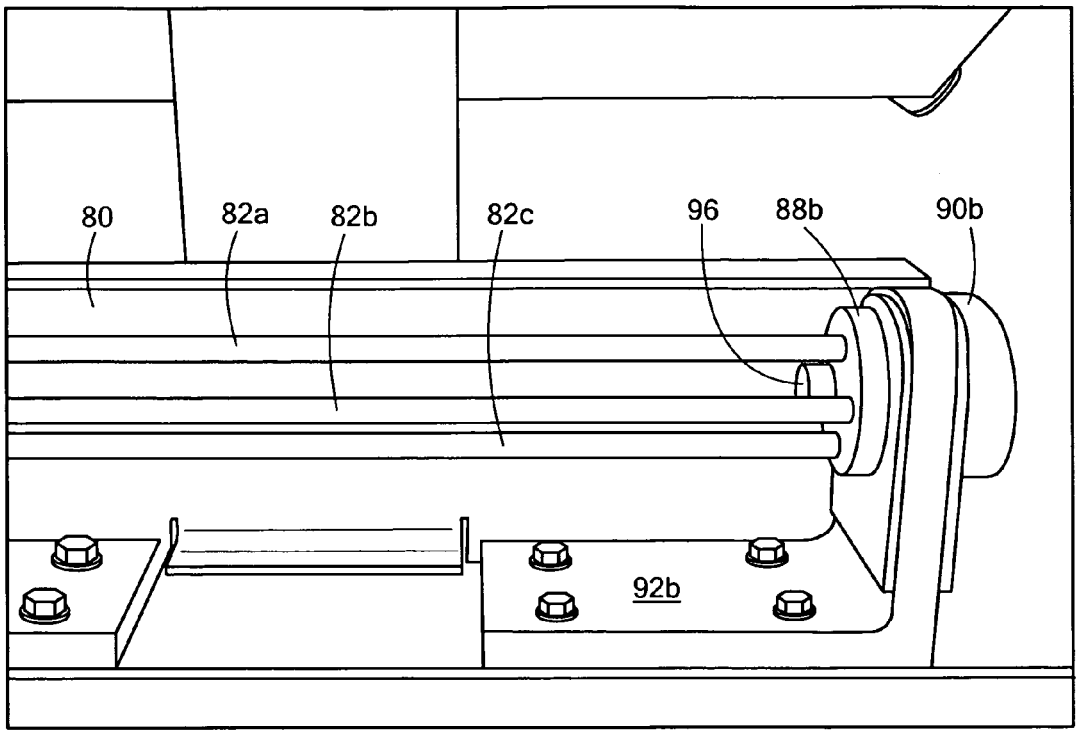
FIG. 9 is a schematic three-dimensional view showing a portion of the torsion bar assembly of the subject invention.
Figure 10:
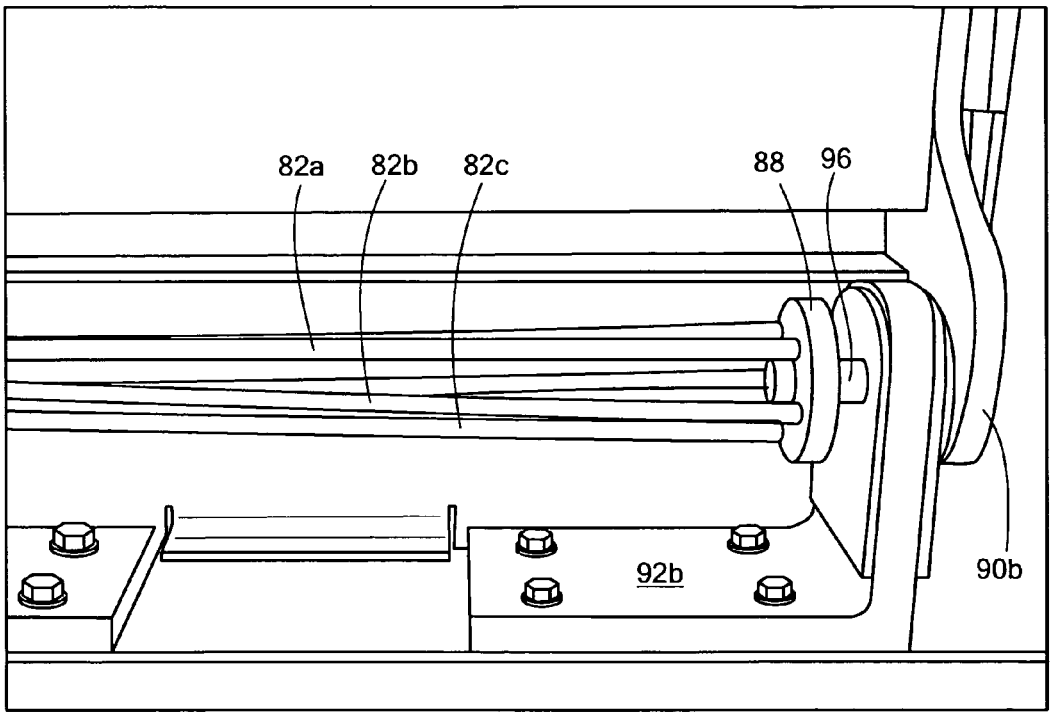
FIG. 10 is another schematic three-dimensional view showing a portion of the torsion bar assembly of the subject invention as the platform deploys.

Slow and effortless deployment of the platform is affected via torsion bar assembly 80, FIG. 9. When bars 82, FIG. 10 undergo torque as shown, the platform is lowered and the oval crank, attached to platform ear 80*b*, drives hub 88.

Figure 11:
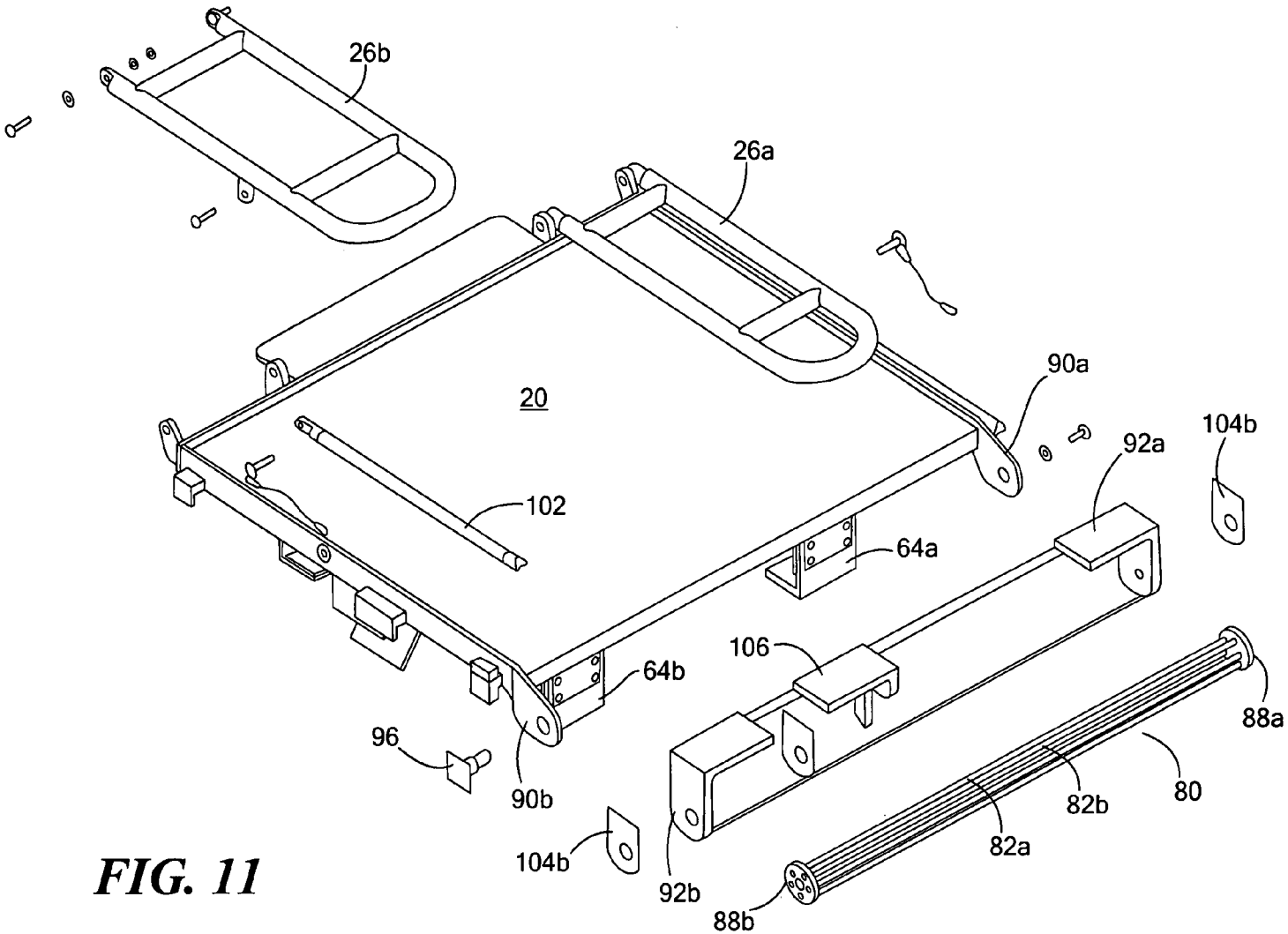
FIG. 11 is a schematic three-dimensional exploded top view showing several of the primary components associated with an example of a platform in accordance with the subject invention.
Figure 12:
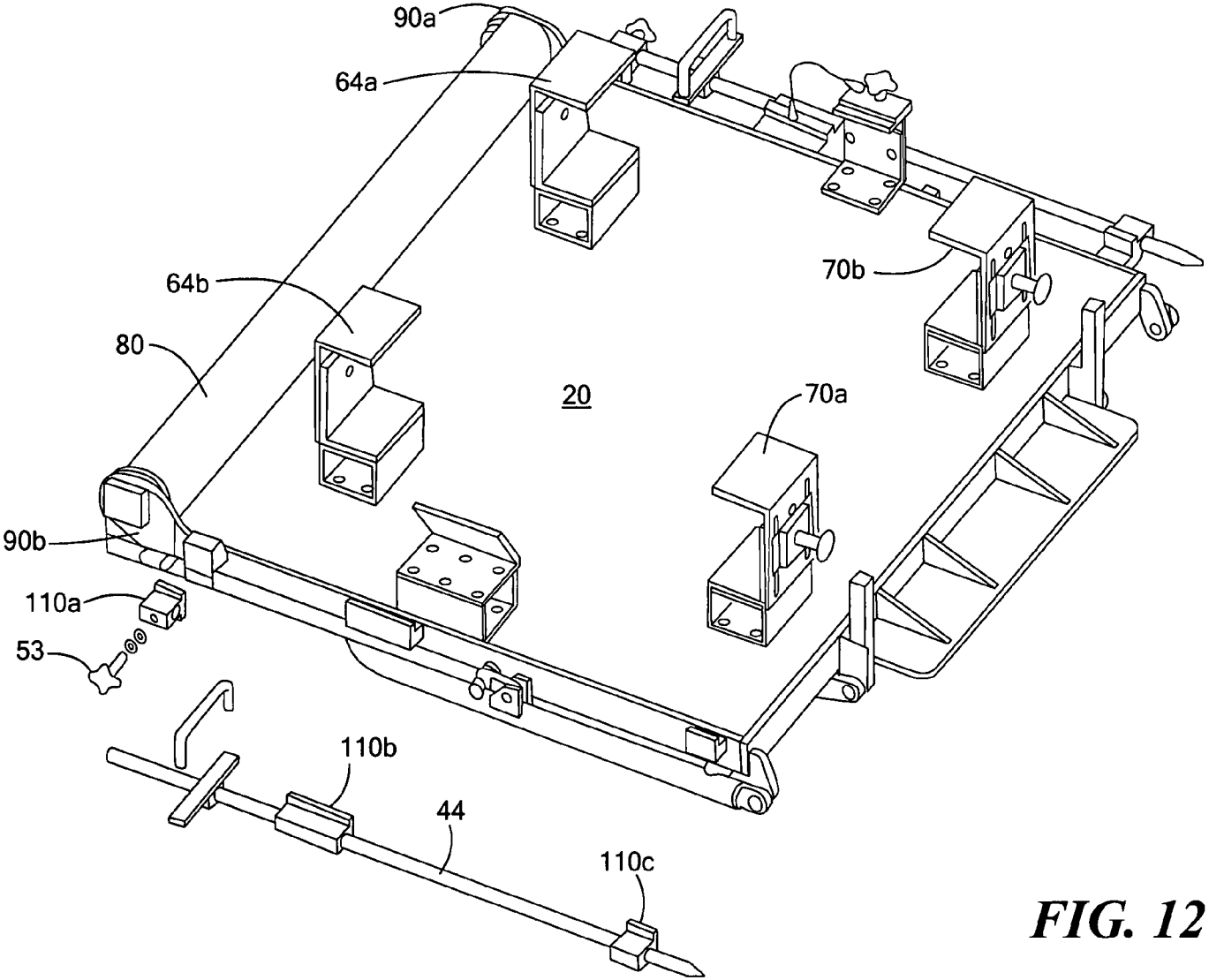
FIG. 12 is a schematic three-dimensional bottom view of the platform shown in FIG. 11.
Figure 13:
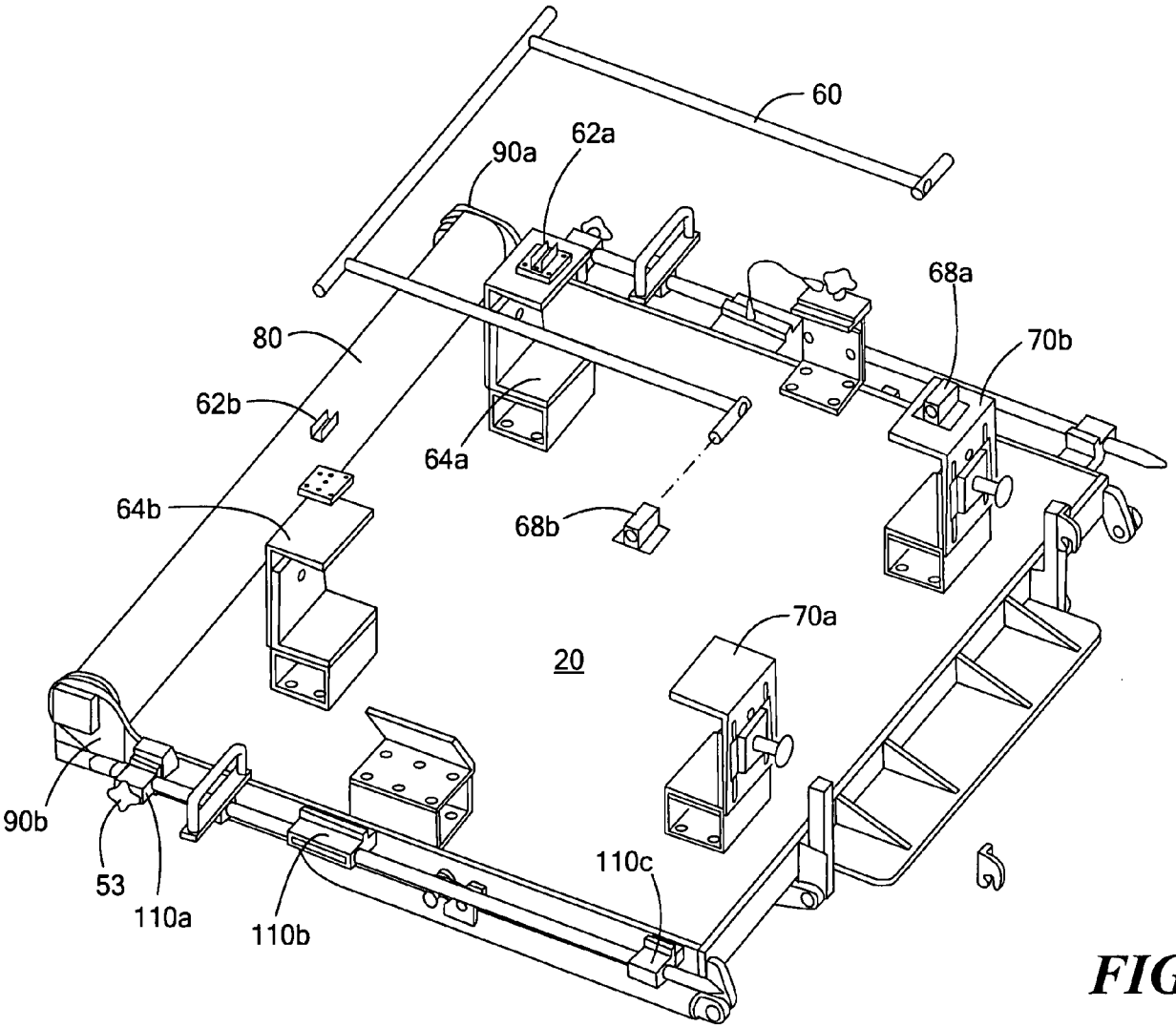
FIG. 13 is another schematic three-dimensional bottom view of the platform shown in FIGS. 11 and 12.

FIGS. 11-13 are exploded views showing several of the primary components associated with a preferred platform. FIG. 11 shows rail support arm 102, hinge spacers 104*a* and 104*b*, and bracket 106. FIG. 12 shows guides 110*a*, 110*b*, and 110*c* for rod 44 and knob assembly 53 which, when released, allows rod 44 to slide in its guides. FIG. 13 shows handle 60, its spring clips 62*a* and 62*b*, and its brackets 68*a* and 68*b*.

Note, however, that the embodiment disclosed above is only one specific embodiment. In other embodiments, the invention hereof may function as a folding dock or platform for a vehicle or other structure and include only a platform and a torsion bar assembly. Aspects of the design discussed above could be implemented on any tactical electronics enclosure or shelter system where a stowable platform is desired. It would also be of value in commercial applications where a heavy tailgate or platform is used and simple, single-person deployment is required. When used in connection with a shelter system, the platform of the subject invention operates independent of the shelter position. The integrated torsion/bending bars mitigate platform weight during stowage and emplacement operations. The ovalized torsion interface reduces stress concentrations permitting the use of standard materials (e.g., aluminum and steel). The platform is designed for a single person emplacement operation from ground level by a $5^{th}$ to a $95^{th}$ percentile operator. The integrated latching mechanisms provides a lateral load constraint to ensure that the load path travels through the shelter and not through the platform. The platform also features the ability to stow the ladder or stair as discussed above. The preferred platform is designed to be compatible with an M-14 protective entrance.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. An entrance module of a height adjustable enclosure or shelter with a top portion movable with the respect to a bottom portion, the entrance module comprising:

a platform hingedly attached to the bottom portion and movable between a stowed folded position and a deployed unfolded position;

a locking assembly for releasably locking the platform in the folded position independent of the position of the top movable portion of the shelter, the locking assembly including:

a rail attached to an exterior of the top movable portion of the shelter, the top movable portion being movable to at least partially cover the bottom portion, one of a female and a male portion of a lock attached to and slideable along the rail, and the other of the female and the male portion of the lock attached to the platform and releasably engageable with the portion of the lock attached to and slideable along the rail.

2. The entrance module of claim 1 in which the male portion includes a rod affixed to and slideable with respect to the platform and the female portion includes a bracket with an orifice for receiving the rod therethrough.

3. The entrance module of claim 1 in which the platform is hingedly attached via a torsion bar assembly.

4. The entrance module of claim 3 in which the torsion bar assembly includes a plurality of bars constrained on one end to rotate with the platform and constrained on the other end to remain fixed as the platform rotates.

5. The entrance module of claim 4 in which the bars of the torsion bar assembly extend between two spaced hubs.

6. The entrance module of claim 5 in which one said hub includes a non-circular orifice therethrough for receiving a non-circular crank which rotates with the platform.

7. The entrance module of claim 1 further including at least one cable support tie connected on one end to the portion of the lock slideable along the rail and attached on the other end to the platform.

8. The entrance module of claim 1 further including a ladder for the platform.

9. The entrance module of claim 8 in which the ladder is removable from the platform and stowable under the platform.

10. The entrance module of claim 1 further including at least one safety railing foldable with respect to the platform.

11. The entrance module of claim 1 further including a protective entrance positionable on the platform.

12. An entrance module of a height adjustable enclosure or shelter with a top portion movable up or down with the respect to a bottom portion, the entrance module comprising:

a platform hingedly attached to an outer surface of said bottom portion, said hingedly attachable platform movable between a stowed folded position and a deployed unfolded position;

a locking assembly for releasably locking the platform in the folded position independent of the up or down movement of the top movable portion of the shelter, the locking assembly including:

a rail attached to the top movable portion of the shelter to move up or down with said top movable portion, the top movable portion being movable to at least partially cover the bottom portion a rod affixed to the platform and slideable with respect to the platform, and a bracket attached to the rail and slideable with respect to said rail, said bracket including an orifice therein for receiving an end of the rod therethrough.

* * * * *